US005101882A

United States Patent [19]

Freeman

[11] Patent Number: 5,101,882

[45] Date of Patent: Apr. 7, 1992

[54] DIE CAST VACUUM VALVE SYSTEM

[75] Inventor: Lewis G. Freeman, Kokomo, Ind.

[73] Assignee: Chrysler Corporation, Highland Park, Mich.

[21] Appl. No.: 493,164

[22] Filed: Mar. 14, 1990

[51] Int. Cl.[5] ..... B22D 18/06; B22D 46/00

[52] U.S. Cl. ..... 164/457; 164/254; 164/257; 164/305; 425/812; 425/563

[58] Field of Search ..... 164/457, 150, 154, 305, 164/410, 254, 257; 425/812, 562, 563

[56] References Cited

U.S. PATENT DOCUMENTS

| | | | |
|---|---|---|---|
| 3,070,857 | 1/1963 | Venus | 164/256 |
| 3,590,114 | 6/1971 | Uhlig | 425/562 |
| 4,027,726 | 6/1977 | Hodler | 164/410 |
| 4,099,904 | 7/1978 | Dawson | 425/563 |
| 4,463,793 | 8/1984 | Thurner | 164/305 |
| 4,577,670 | 3/1986 | Moore | 164/305 |
| 4,680,003 | 7/1987 | Schulte | 425/562 |

FOREIGN PATENT DOCUMENTS

| | | | |
|---|---|---|---|
| 346361 | 6/1960 | Fed. Rep. of Germany | 425/562 |
| 57-81949 | 5/1982 | Japan | 164/305 |
| 58-97478 | 6/1983 | Japan | 164/305 |

*Primary Examiner*—Richard K. Seidel
*Assistant Examiner*—Rex E. Pelto
*Attorney, Agent, or Firm*—Edward P. Barthel

[57] ABSTRACT

A die casting vacuum valve has a cover die block and ejector die block. A cushion member is positioned in the cover die block and a reciprocating member is positioned in the ejector die block such that upon reciprocation of the reciprocating member, it contacts the cushion member and cover die block to seal the reciprocating member with the cover die block and the surrounding surface. A controller mechanism controls the reciprocation of the reciprocating member such that the reciprocating member contacts the cushion when the molten material enters the mold cavity and slot to prevent further flow of the molten material in the slot past the reciprocating member.

18 Claims, 6 Drawing Sheets

DIE CAST VACUUM VALVE SYSTEM

BACKGROUND AND SUMMARY OF THE INVENTION

The present invention relates to die casting vacuum valves and, more particularly, to a vacuum valve system coupled with a die cast pair to evacuate fluid, such as air, from the die cavity prior to injection of a molten material into the cavity.

In vacuum die casting, it is desirous to remove air and gasses from the casting cavity prior to injection of a molten metal shot. Evacuation of the cavity is generally accomplished by a venting device coupled with the cavity and mold dies. Optimum evacuation results in optimum flow of the molten material into the cavity which, in turn, eliminates poor surface finish, porosity and provides a desired casting.

Several types of systems and valves exist which attempt to evacuate the die cavity. The systems and valves are illustrated by the following U.S. patents: F. Hodler U.S. Pat. No. 2,785,448, Mar. 19, 1957; F. Hodler U.S. Pat. No. 2,867,869, Jan. 13, 1959; D. M. Morgenstern U.S. Pat. No. 2,904,861, Sept. 22, 1959; W. Venus U.S. Pat. No. 3,070,857, Jan. 1, 1963; F. Hodler U.S. Pat. No. 3,433,291, Mar. 18, 1969; Hodler U.S. Pat. No. 3,885,618, May 27, 1975; Hodler U.S. Pat. No. 4,027,726, June 7, 1977; Ernst et al U.S. Pat. No. 4,729,422, Mar. 8, 1988; Ruhlandt et al U.S. Pat. No. 4,779,666, Oct. 25, 1988; Uchida et al U.S. Pat. No: 4,782,886,Nov. 8, 1988; Voss et al U.S. Pat. No. 4,809,767, Mar. 7, 1989; Voss et al U.S. Pat. No. 4,825,933, May 2, 1989; Klenk U.S. Pat. No. 4,832,109, May 23, 1989. While the above patents appear to perform satisfactorily for their intended purpose, designers are always striving to improve the art.

Accordingly, the present invention provides the art with a new and improved vacuum valve adapted to be coupled with a casting die pair or integrated with the die blocks in a vacuum casting apparatus. The present invention provides the art with a vacuum valve which includes a cushioning mechanism which prevents excessive wear on the interior of the valve housing. The present invention provides a vacuum valve which is coupled with a controller to close the vacuum valve as the shot is injected into the die cavity. Also the invention provides the art with a vacuum valve that is relatively simple and economical in manufacture and repair.

From the below detailed description taken in conjunction with the accompanying drawings and subjoined claims, other objects and advantages of the present invention will become apparent to those skilled in the art.

DETAILED DESCRIPTION OF THE PREFERRED EMBODIMENT

Figure 1:
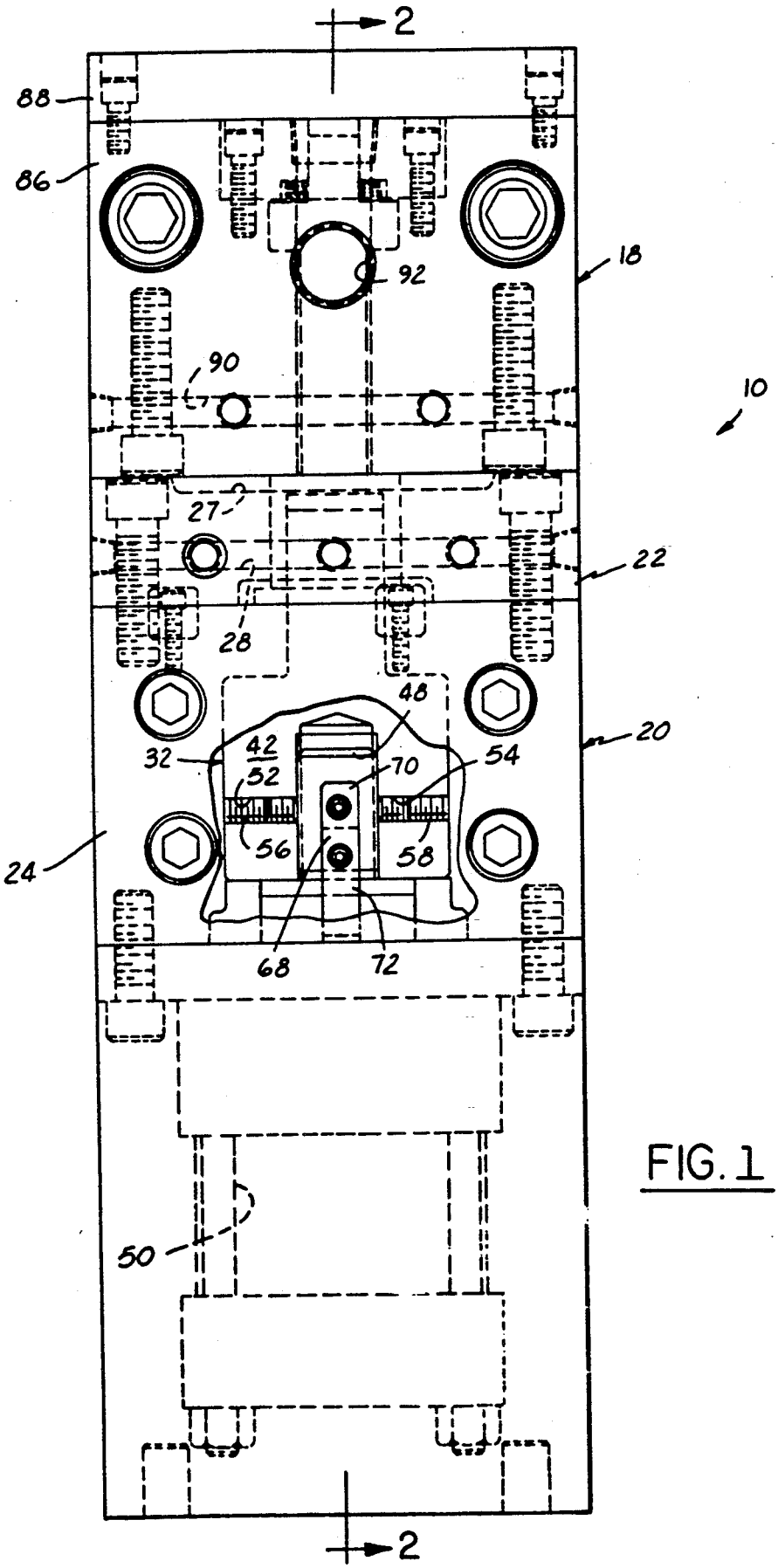
FIG. 1 is an elevation view of a vacuum valve in accordance with the present invention with a portion broken away.

Turning to the Figures, preferably FIGS. 1–4, a vacuum valve is illustrated and designated with the reference numeral 10. The vacuum valve 10 is associated with a die pair including a cover die and ejector die designated with reference numerals 12 and 14 as illustrated partially in phantom in FIG. 2. The cavity (not shown) is generally in both of the dies and is separated by a parting line or plane 16 which is formed between the cover die 12 and the ejector die 14.

Figure 2:
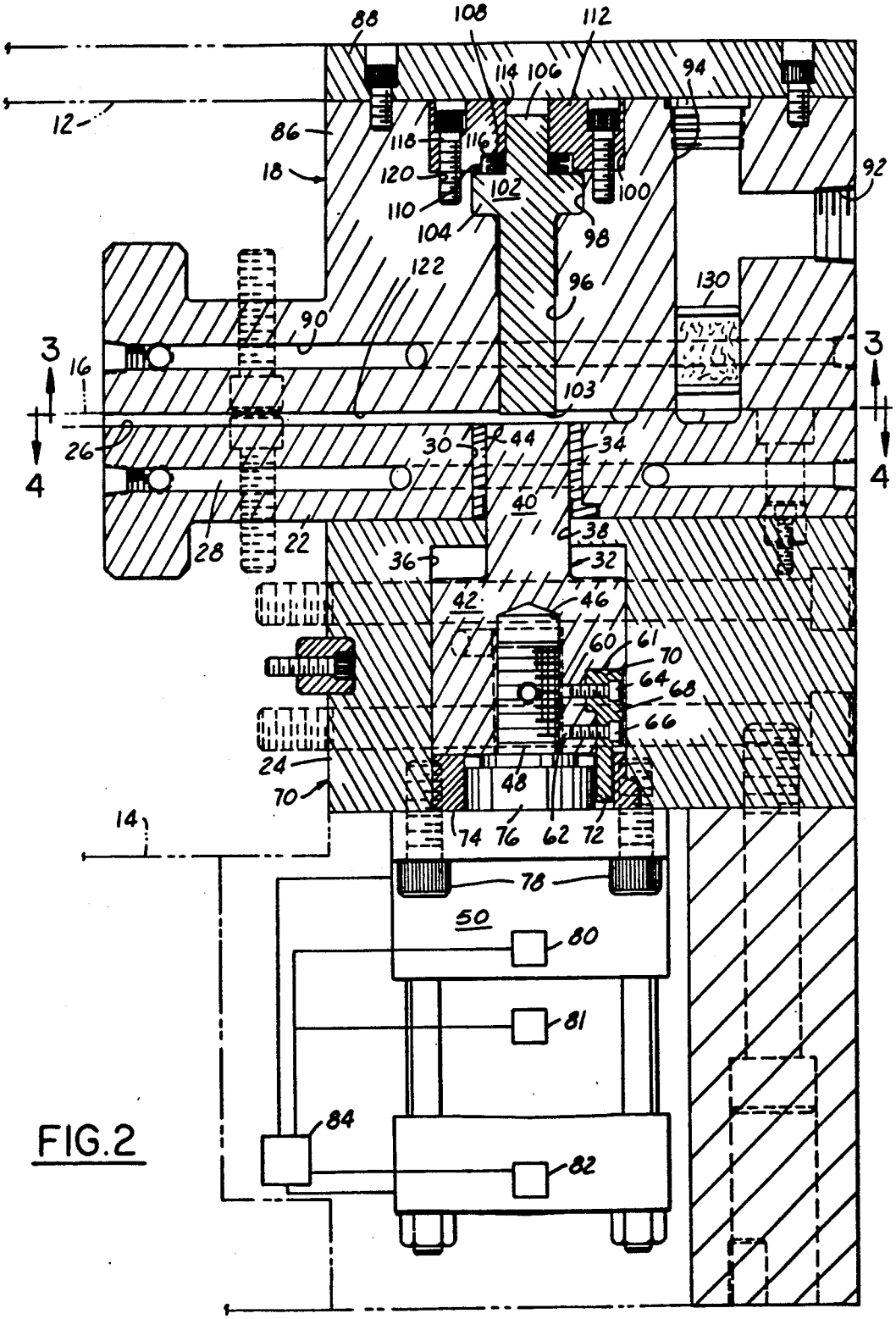
FIG. 2 is a cross-sectional view of the valve of FIG. 1 the section being taken along a plane defined by line 2—2 thereof.

The vacuum valve 10 has two major halves, a cover die block 18, connected to the cover die 12, and an ejector die block 20, coupled with the ejector die 14. These two blocks 18 and 20 form the housing of the vacuum valve 10. As can be seen in FIGS. 1 and 2, the blocks 18 and 20 are generally rectangular. Optionally, the die blocks 18 and 20 may be built into the dies 12 and 14 and an integral part thereof.

The ejector block 20 includes an ejector top plate 22 and a piston block 24. The ejector top plate 22 includes a slot or notch 26 enabling an overflow runner to be formed therein when the cavity is filled with molten material. The ejector top plate 22 includes a passageway 28. A bore 30 is in the upper ejector plate to provide a passage for a shutoff piston 32. A bushing 34 is positioned in the bore 30. The ejector plate 22 also includes an overflow trough 27 which provides an access area if the shut-off piston 32 does not pinch off, in time, the flow of the molten material along the slot 26. Thus, the ejector plate 22 provides an area for overflow of molten material.

The piston block 24 is secured to the ejector top plate 22. The piston block 24 includes an enlarged countersunk bore 36 which houses the shutoff piston 32. A smaller diameter bore 38 connects the bore 36 with the bore 30. The bores 30, 36 and 38 forming a central bore through the ejector block 20.

The shutoff piston 32 generally includes an elongated cylindrical neck 40 and a body 42. The neck 40 and body 42 are generally of a unitary one-piece construction being circular in cross-section. The neck 40 being of a diameter less than the body 42 includes a cutout portion 44 on its free extending end for lifting out the molded runner upon ejection of a casting. The body 42 includes a bore 46 to enable securement of a push rod 48 from a hydraulic cylinder 50 or the like, which moves the shut-off piston 32 within the bores 36, 38 and 40. A plurality of threaded bores 52 and 54 in the body 42 receive set screws 56 and 58 to secure the shutoff piston 32 onto the push rod 48 of the cylinder 50 as illustrated in FIG. 1. Generally, the bores 52 and 54 oppose one another at a 180° angle. Also, the body 42 includes a keyway 61 and threaded bores 60 and 62 which receive guide pin 68 and fasteners 64 and 66, which retain guide pin 68 in the keyway 61.

Guide pin 68 generally has an elongated rectangular shape, as seen in FIG. 1, with an enlarged head 70. The enlarged head 70 and a portion of tail 72 fit into the keyway 61 on the piston body 42 as seen in FIG. 2. The guide pin tail 72, which fits between a cylinder bushing 74 and the cylinder cap 76, guides and steadies the movement of the shut-off piston 32 within bores 36, 38 and 30.

A cylinder 50 is secured to the piston block 24 by fasteners such as bolts 78. The cylinder 50 is generally of the hydraulic type, however, pneumatic cylinders may be used. The cylinder 50 is coupled with one or more limit switches 80, 81 and 82 which, in turn, are coupled with a controller 84. Other types of switches, such as a temposonic wand, may be utilized in place of the limit switches. The controller 84 along with limit switches 80, 81 and 82 control the movement of the shut off piston 32, via the cylinder 50, in response to injecting of molten material into the die cavity.

Figure 3:
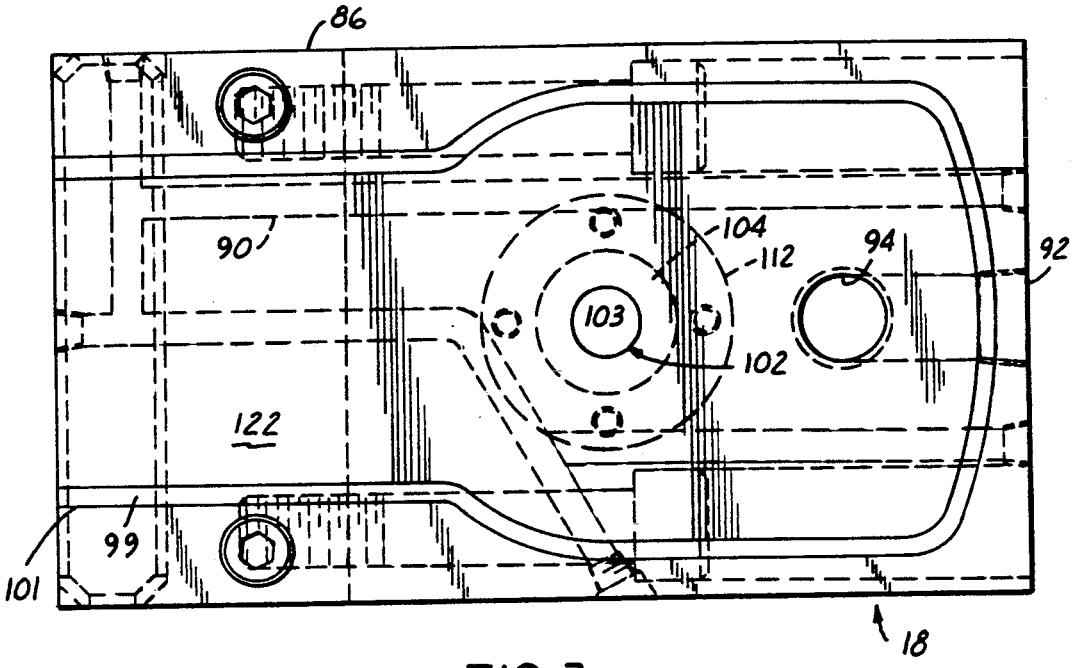
FIG. 3 illustrates a plan view of FIG. 2 along a plane defined by the line 3—3 thereof.
Figure 4:
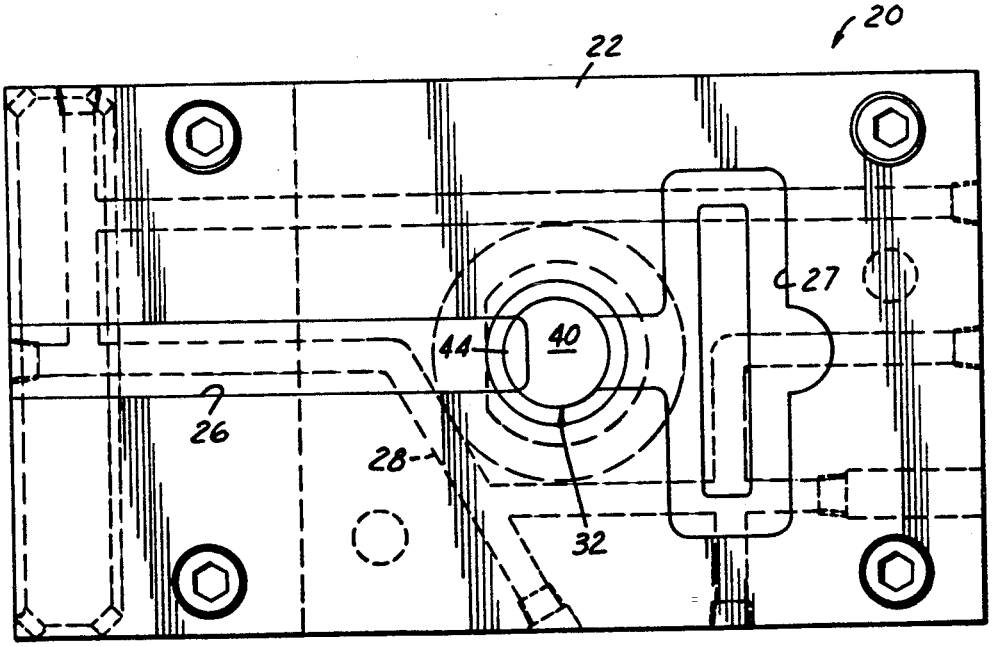
FIG. 4 illustrates a plan view of FIG. 2 along a plane defined by the line 4—4 thereof.

The cover die block 18 is generally rectangular and is adapted to be associated with the cover platen 12 of the die pair. The cover die block 18 generally includes a cover block 86 and may include an optional plate 88. The cover block 86 includes a passage 90, and a vacuum port 92 opening into an enlarged venting passage 94. A vacuum system (not shown) is adapted to be coupled with the vacuum port 92 to draw air and fluid from the cavity, through the valve 10. The vacuum is drawn through the valve 10 via slot 26, overflow trough 27 and venting passage 94 while the shut-off piston 32 is out of contact with the cushion piston 102. An optional seal 99 may be positioned within an optional sealing groove 101 on the face of the cover block 18 as seen in FIG. 3. A central bore 96, substantially coincident with the die block central bore, extends through the cover block 86 and has a pair of enlarged stepped bores 98 and 100. The bore 96 with step bores 98 and 100 enables securement of a cushion piston 102 within the cover block 86.

The cushion piston 102 is cylindrical with a radially extending flange 104 and a cylindrical head 106. The flange 104 and head 106 give the piston an overall shape of a cross as viewed in cross-section in FIG. 2. The cushion piston 102 fits within the bore 96 with the flange 104 seating in step bore 98.

Once the cushion piston 102 is placed into the bore 96, one or more preloaded washers 108, such as Belleville washers, are positioned peripherally about the head 106 resting on the shoulder surface 110 of the peripheral flange 104. The washers 108 provide the biasing force to yieldably retain and return the cushion piston 102 to its original position after it has been contacted by shut-off piston 32. A cover retainer 112, having a bore 114 with a step portion 116, is positioned over the cushion piston head 106 to retain the cushion piston 102 within the cover block 86 such that the bore 114 fits about the periphery of the head 106 and the step 116 positions about the washers 108. A plurality of screws 118 are threadably received into threaded bores 120 in the cover block 86 for loading the washers 108.

The piston 102 has a portion 103 that extends beyond the surface 122 of the cover block 86 as seen in FIG. 2. This portion 103 of the piston 102 is in its first resting or original position extending beyond the surface 122 when the piston 102 is loaded in the cove block and secured therein by the retaining cover 112. The cushion piston 102 is contacted by the shut-off piston 32 when the shut-off piston 32 is closed in response to the molten material entering the cavity. The cushion piston 102 cushions the shut-off piston 32 as it tightly clamps and closes the parting line 16 at the slot 26. As the shut-off piston 32 actuates upward, the cushion piston 102 moves upward against the washers 108 such that the end portion 103 of piston 102 becomes flush with the surface 122 of the cover block 86. At this time, the shut-off piston 32 contacts the cover block surface 122 peripherally about the cushion piston 102 sealing the shut-off piston 32 with the cover block 86 to terminate flow through slot 26. Also, a clearance is present between cover retainer 112 and the shoulder 110 of the flange 104 to enable the cushion piston 102 to move upward and become flush with the cover surface 122. Once the shut-off piston 32 is removed from contact with the cushion piston 102, the washers 108 bias the piston 102 back to its normal or original position where end portion 103 of cushion piston 102 extends from the surface 122 of the cover block 86.

An optional filter 130 may be positioned in the venting passage 94 to filter the gas and fluid exiting the cavity. Also, a sensor may be associated with the filter 130 to monitor the flow of gas and fluid through the filter 130. Should the filter 130 become clogged the sensor would indicate that the desired vacuum is not being drawn from the cavity and through the valve 10 thus indicating that a problem exists.

A brief explanation of the vacuum casting process is as follows. The die cavity is filled by molten material entering the cavity from a shot sleeve. A hydraulic shot cylinder pushes the molten material in the shot sleeve into the cavity. The shot bar, coupled with the shot cylinder, covers the port hole in the shot sleeve, which enables molten material to be injected into the shot sleeve, the molten material to be injected into the cavity is trapped within the shot sleeve. As this occurs, a signal is sent from the controller 84 to the cylinder 50 to drive the shut-off piston 32 toward the parting line 16, as illustrated in FIG. 2. As the shut-off piston 32 reaches the parting line 16, one of the limit switches on the cylinder 50 is tripped transmitting a signal back to the controller 84 that the shut-off piston 32 has reached or is very near the parting line 16. In response to this signal, the controller 84 transmits a signal to the vacuum casting apparatus to enter into a fast shot mode and to inject the molten material into the cavity to fill the same. As this occurs, the cylinder 50 continues to drive the shut-off piston 32 very quickly toward the cushion piston 102. The shut-off piston 32 closes off the slot 26 to stop the flow of molten material past the shut-off piston 32 to prevent overflow but yet still insures full gas evacuation of the die cavity, via the passage framed by slot 26, overflow trough 27 and venting passage 92, filling the die cavity with molten metal. If the cushion piston 102 was not present, the quick movement of the shut-off piston 32 would pound the cover block surface 122 requiring continual replacement.

As the shut-off piston 32 hits the cushion piston 102 and surface 122 sealing off the vacuum passage another limit switch is activated transmitting a signal to the controller 84 indicating that the shut-off piston 32 has reached this limit. After receiving this signal the system has two options. First, the controller 84 transmits a signal to the vacuum casting apparatus which indicates that the cavity is full and to stop further injection of the material and return the apparatus to its starting position. The controller transmits a signal to the cylinder 50 to return the shut-off piston 32 to its down position. Once this occurs, one of the limit switches is triggered transmitting a signal to the controller 84 that the cylinder 50 has reached its starting position. Second, the controller 84 transmits a signal to the vacuum casting apparatus which indicates that the cavity is full and to stop further injection of the material and deactivate cylinder 50. At this time, the dies would be separated and the cylinder 50 would again be actuated by the controller 84 driving the shut-off piston 32 upward beyond the limit where the shut-off piston 32 contacted the cushion piston 102 thus moving the lower surface of notch 44 outwardly from the surface of passage 26 defined by ejector plate 22 to eject a runner from the slot 26 enabling the casting formed in the cavity to be removed therefrom.

Moving to FIGS. 5–8, a second embodiment of a vacuum valve in accordance with the present invention is illustrated. The vacuum valve in FIGS. 5–8 illustrates a cylinder having movement transverse to the shut-off piston axis instead of axial movement as illustrated in FIGS. 1–4.

The vacuum valve 200 includes a die block 202 and a cover block 204. The die block and cover block 202 and 204 function similarly to those previously discussed.

The die block 202 includes a piston block 206 and an ejector plate 208. The ejector plate 208 includes a slot 210 for a runner, an overflow trough 212, a bore 214 and a passage 216 like those previously described. Also, a bushing 218 is positioned within the bore 214 like that previously discussed above. Keys 220 and 222 may be positioned in slots on the ejector plate and piston block 206 to aid in positioning the ejector plate 208 with respect to the piston block 206.

The piston block 206 includes an upper and lower plate 224 and 226. The upper and lower plates 224 and 226 included an enlarged bore 228 for housing the shut-off piston 230 therein. The plates 224 and 226 are held together by a plurality of fasteners 232. The bore 228 is coupled with a smaller diameter bore 234 to couple it with the bore 214 of the ejector plate 208. The bores 214, 228 and 234 form a central bore through the die block 202.

The shut-off piston 230 is generally cylindrical having a neck 238, with a circular cross-section, and body 240 with a rectangular preferably square cross-section. The neck 238 extends through the bore 234 into the bushing 218 to extend therefrom to terminate flow of the molten material as previously described.

Figure 5:
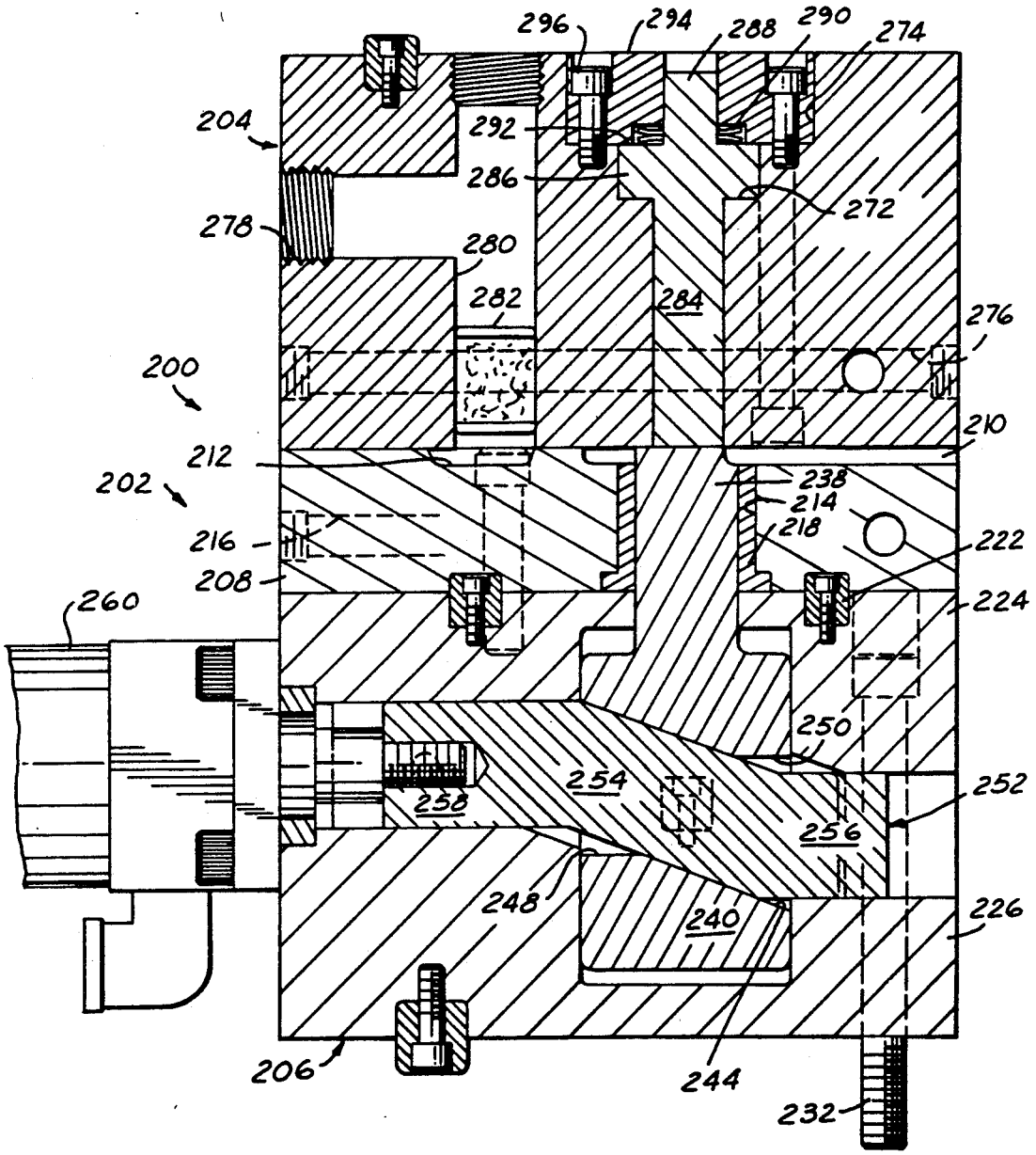
FIG. 5 illustrates a cross-section view of another embodiment of a vacuum valve in accordance with the present invention.
Figure 6:
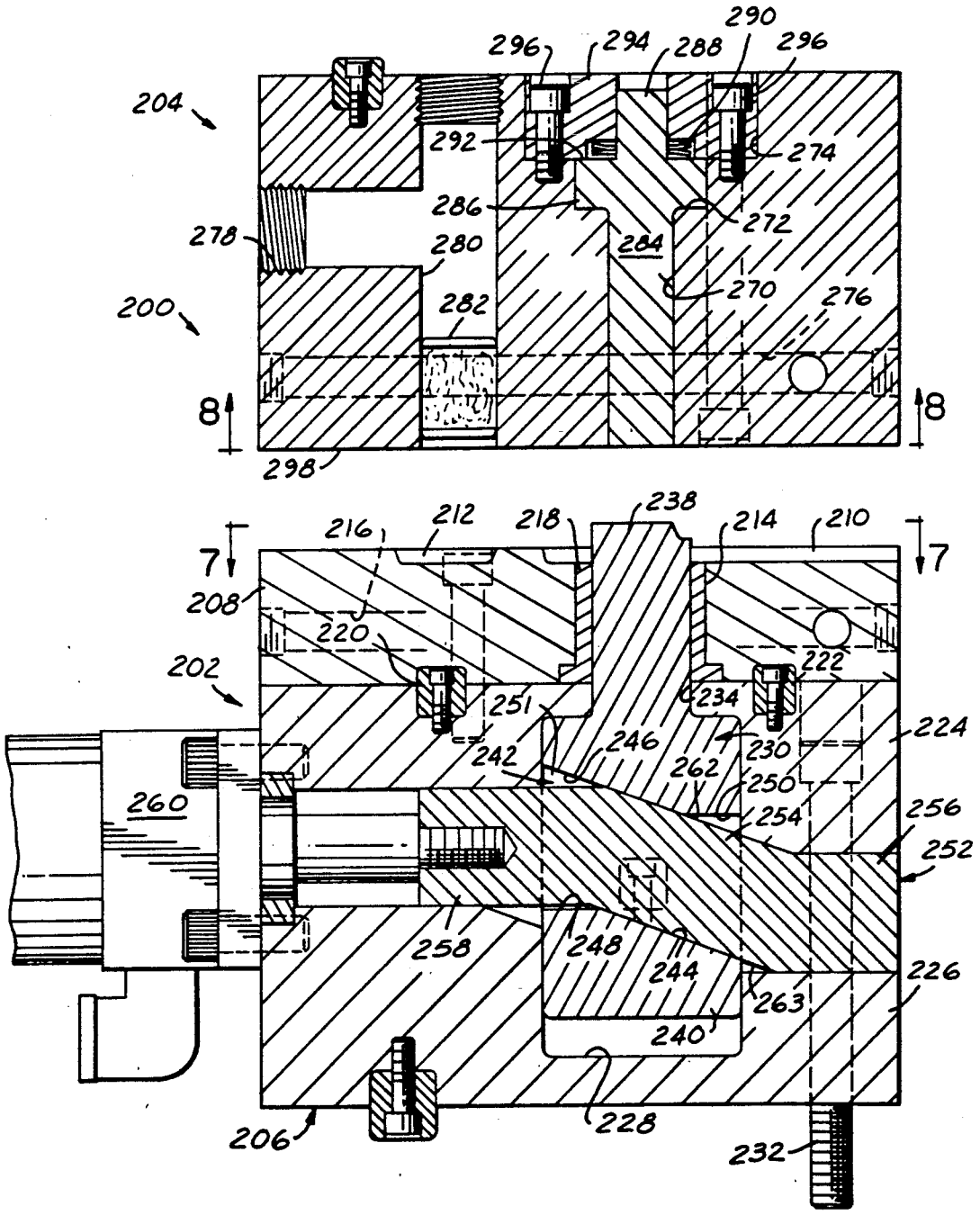
FIG. 6 is a cross-section view similar to that of FIG. 5 with the valve halves separated and the piston in a position to eject a runner.
Figure 8:
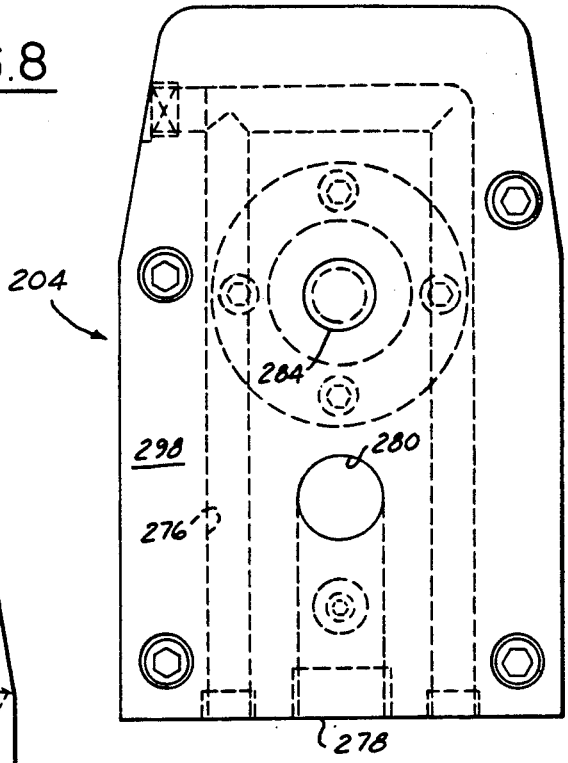
FIG. 8 is a plan view of FIG. 6 along a plane defined by line 8—8 thereof
Figure 7:
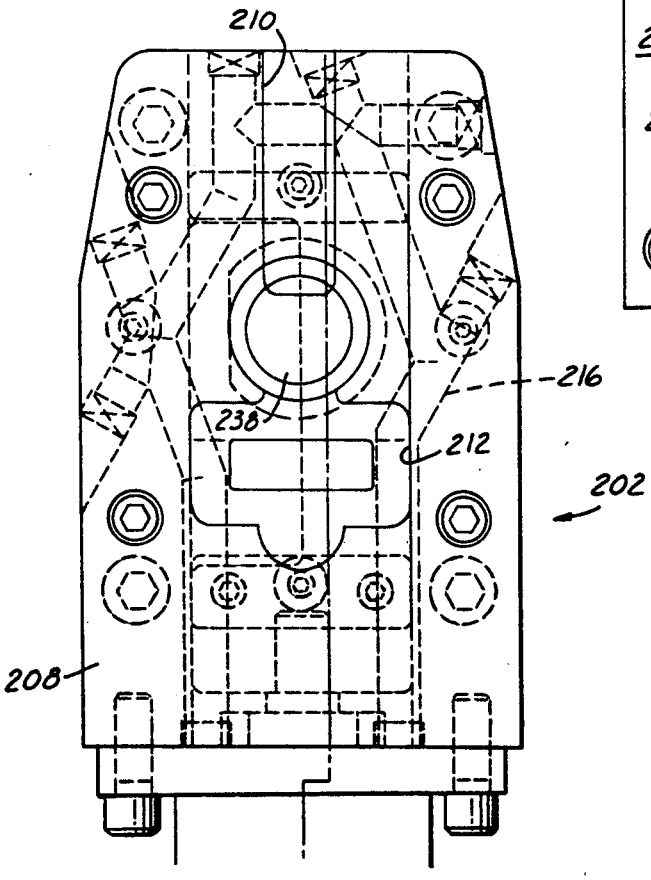
FIG. 7 is a plan view of FIG. 6 along a plane defined by line 7—7 thereof.

The body 240 includes a slot 242 through a portion of the body 240 transverse to the axis of the shut-off piston 230. The slot 242 is defined by angled bottom and top walls 244, 246, planar bottom and top walls 248 and 250 and back wall 251. Thus, the tunnel 242 is at an angle through the body 240 of the shut-off piston 230. The rectangular tunnel 242 enables positioning of a plunger 252 through the slot 242 as seen in FIG. 5.

The plunger 252, having an overall rectangular shape, includes an angular portion 254 and a pair of horizontal portions 256 and 258 on each side of the angular portion 254. One of the horizontal portions 258 is coupled with a hydraulic cylinder 260 like that previously described. The cylinder 260, having a longitudinal axis transverse to the central bore axis, also includes limit switches and the controller like that discussed above. The plunger 252 includes surfaces 262 and 263 which contacts with angled top and bottom walls 246 and 244. As the cylinder 260 is actuated, moving the plunger 252 forward and back, the surfaces 262 and 263 contacts wall surfaces 244 and 246 moving the shut-off piston 230 up and down in the central bore to close the slot 210, like that previously discussed.

The cover block 204 includes a bore 270 having stepped bores 272 and 274, a passage 276 and a vacuum valve port 278 and venting passage 280 like those previously discussed. Also an optional filter 282 like that discussed may be included with the cover block 204. The cushion piston 284 is substantially similar to that previously discussed having a peripheral radially extending flange 286 and a cylindrical head 288. Washers 290 are positioned on the shoulder surface 292 of the radial flange 286 and a retaining cover 294 having fasteners 296 is secured to the cover block 204 to retain the cushion piston 284 therein.

The cushion piston 284 extends a desired distance from the surface 298 of the die block 204. The valve 200 operates substantially the same as that of the valve 10 previously described.

While the above detailed description describes the preferred embodiment of the present invention, it will be understood that the present invention is susceptible to modification, variation and alteration without deviating from the scope and fair meaning of the subjoined claims.

What is claimed is:

1. A vacuum valve adapted to be coupled with a die pair with a cavity generally in both dies and separated by a parting line or plane between the die pair, said vacuum valve comprising:

an ejector die block adapted to be coupled with one die of said die pair and including a slot adapted for enabling flow of molten material from said cavity within the die pair, a reciprocating means adapted for reciprocating movement in said die block;

a cover die block adapted to be coupled with the other die of said die pair including a cushion means adapted to be contacted by said reciprocating means during reciprocation of said reciprocating means and a surface surrounding said cushion means, said cushion means extending a small desired distance from said cover die block such that upon reciprocation, said reciprocating means contacts said cushion means blocking said slot and said cushion means cushioning movement of said reciprocating means into sealing contact with said cushion means and said surrounding surface;

said ejector die and cover die are coupled with the die pair so that said slot is positioned adjacent the parting line or plane of the die pair and a surface of said cover die is substantially coplanar with the parting line or plane such that said reciprocating means contacts said cushion means in said slot so that molten material entering said slot from the cavity is prevented from further flow by said reciprocating means blocking said slot along the parting line or plane and to insure substantially full gas evacuation of the die cavity; and control means for controlling the reciprocation of said reciprocating means.

2. The vacuum valve according to claim 1 wherein said cover die block and ejector die block includes a passage system adapted to couple with a vacuum to draw a fluid through the cavity and said valve.

3. The vacuum valve according to claim 2 further comprising a filter means associated with said passage system.

4. The vacuum valve according to claim 1 wherein said reciprocating means includes a piston in said ejector die block coupled with a hydraulic cylinder.

5. The vacuum valve according to claim 4 wherein a central axis of said hydraulic cylinder is substantially transverse to a central axis of said cushion means.

6. The vacuum valve according to claim 5 wherein said reciprocating means piston includes a slot transverse to a central axis of said piston said slot defined by a pair of walls in said piston, said walls being at an angle with respect to a transverse axis and a plunger coupled with the hydraulic cylinder having a pair of cam surfaces with angles complementary to said slot walls wherein movement of said cylinder reciprocates said piston.

7. The vacuum valve according to claim 1 wherein said cushion means includes a piston including a circumferential flange, said piston positioned in a bore in said cover die block and a resilient biasing means for biasing said piston from a first position to a second position, said biasing means positioned about said piston seated on said circumferential flange of said piston.

8. The vacuum valve according to claim 7 wherein said biasing means is comprised of one or more preloaded washers.

9. The vacuum valve according to claim 1 wherein said cushion means and reciprocating means are positioned coaxially.

10. A vacuum valve adapted to be coupled with a die pair with a cavity generally in both dies and separated by a parting line or plane between the die pair, said vacuum valve comprising:

an ejector die block adapted to be coupled with one die of said die pair and including a slot adapted to provide for flow of a molten material, a central bore through said die block, said central bore having an enlarged portion, and said slot associated with said central bore;

a piston having a first portion and an enlarged second portion positioned in said ejector die block central bore;

means for reciprocating said piston in said bore, said reciprocating means coupled with said piston and mounted on said ejector die block;

a cover die block adapted for coupling with the other die of said die pair and including a central bore, said central bore having an enlarged portion, and a passage through said cover die block adapted to be coupled with a vacuum source and a surface surrounding said central bore of said cover die block;

cushion means positioned in said central bore, said cushion means including a piston with a circumferential flange extending radially therefrom and positioned in the enlarged bore portion of the cover die block, a resilient biasing member seated on said circumferential flange for biasing said piston in said cover die block, portion of said piston extending from said cover die block such that upon reciprocation of said reciprocating means, said ejector die block piston contacts said cover die block piston, said cover die block piston cushioning said ejector die block piston travel enabling sealing contact of said ejector die block piston with said cushion means piston and said surrounding surface while inhibiting potentially damaging impacts therebetween;

said ejector die and cover die are coupled with the die pair so that said slot is positioned adjacent the parting line or plane of the die pair and a surface of said cover die is substantially coplanar with the parting line or plane such that said piston contacts said cushion means in said slot so that molten material entering said slot from the cavity is prevented from further flow by said piston blocking said slot along the parting line or plane and to insure substantially full gas evacuation of the die cavity; and a controller controlling reciprocation of said reciprocation means.

11. The vacuum valve according to claim 10 wherein said reciprocation means being comprised of a hydraulic cylinder.

12. The vacuum valve according to claim 11 wherein an axis of said hydraulic cylinder is substantially transverse to a central axis of said cushion means.

13. The vacuum valve according to claim 12 wherein said ejector die block piston includes a slot transverse to a central axis of said piston, said slot defined by a pair of walls in said piston said walls being at an angle with respect to a transverse axis and a plunger coupled with the hydraulic cylinder having a pair of cam surfaces with an angle complementary to said slot walls.

14. The vacuum valve according to claim 10 wherein said biasing means is comprised of one or more preloaded washers.

15. The vacuum valve according to claim 10 wherein said cushion piston and ejector die piston are positioned coaxially.

16. The vacuum valve according to claim 10 further comprising a filter means associated with said passage.

17. The vacuum valve according to claim 10 wherein said ejector die block piston includes a notch for ejecting a runner from said slot.

18. A vacuum valve adapted to be coupled with a die pair with a cavity generally in both dies and separated by a parting line or plane between the die pair, said vacuum valve comprising:

an ejector die block adapted for coupling with one die of said die pair and including a slot adapted to provide for flow of a molten material, a central bore through said die block, said central bore having an enlarged portion, said slot associated with said central bore, and a reservoir slot in said ejector die block associated with said central bore, said reservoir slot adapted to provide for overflow of the molten material;

a piston having a first portion and an enlarged second portion positioned in said ejector die block central bore;

a hydraulic cylinder for reciprocating said piston in said bore, said hydraulic cylinder coupled with said piston and mounted on said ejector die block;

a cover die block adapted for coupling with the other die of said die pair and including a central bore, said central bore having an enlarged portion, and a passage through said cover die block adapted to be coupled with a vacuum source and a surface surrounding said central bore of said cover die block;

cushion piston positioned in said central bore, said cushion piston including a circumferential flange extending radially therefrom and positioned in the enlarged bore portion of the cover die block, at least one preloaded washer seated on said circumferential flange for biasing said cushion piston in said cover die block, a portion of said cushion piston extending from said cover die block such that upon reciprocation of said hydraulic cylinder, said ejector die block piston contacts said cover die block cushion piston, said cover die block cushion piston cushioning said ejector die block piston travel enabling sealing contact of said ejector die block piston with said cushion piston and said surrounding surface and substantially eliminating pounding of said cover die block by said ejector die block piston;

said ejector die and cover die blocks are coupled with the die pair so that said slot is positioned adjacent the parting line or plane of the die pair and a surface of said cover die is substantially coplanar with the parting line or plane such that said piston contacts said cushion piston in said slot so that molten material entering said slot from the cavity is prevented from further flow by said piston blocking said slot along the parting line or plane and to insure substantially full gas evacuation of the die cavity; and a controller controlling reciprocation of said hydraulic cylinder.

* * * * *